US010215403B2

(12) United States Patent
Wei et al.

(10) Patent No.: US 10,215,403 B2
(45) Date of Patent: Feb. 26, 2019

(54) GAS PREMIX BURNER AND GAS WATER HEATER

(71) Applicant: A. O. Smith Corporation, Milwaukee, WI (US)

(72) Inventors: Ruihong Wei, Nanjing (CN); Jingzhan Yang, Nanjing (CN)

(73) Assignee: A. O. Smith Corporation, Milwaukee, WI (US)

( * ) Notice: Subject to any disclaimer, the term of this patent is extended or adjusted under 35 U.S.C. 154(b) by 0 days.

(21) Appl. No.: 15/523,273

(22) PCT Filed: Nov. 4, 2015

(86) PCT No.: PCT/CN2015/093788
§ 371 (c)(1),
(2) Date: Apr. 28, 2017

(87) PCT Pub. No.: WO2016/074582
PCT Pub. Date: May 19, 2016

(65) Prior Publication Data

US 2017/0314779 A1 Nov. 2, 2017

(30) Foreign Application Priority Data

Nov. 13, 2014 (CN) ..... 2014 1 06428075

(51) Int. Cl.
*F23D 14/02* (2006.01)
*F23D 14/26* (2006.01)
(Continued)

(52) U.S. Cl.
CPC ..... *F23D 14/02* (2013.01); *F23D 11/406* (2013.01); *F23D 14/14* (2013.01); *F23D 14/26* (2013.01);
(Continued)

(58) Field of Classification Search
CPC ..... F23D 14/02; F23D 14/26; F23D 14/58; F23D 14/14; F23D 14/16; F23D 14/145; F24H 9/1836
(Continued)

(56) References Cited

U.S. PATENT DOCUMENTS 4,203,553 A * 5/1980 Bachman ..... B01J 12/005 239/288
5,318,438 A * 6/1994 Sugahara ..... F23D 14/045 126/92 R
(Continued)

FOREIGN PATENT DOCUMENTS

CN 102022731 4/2011
CN 102052671 5/2011
(Continued)

OTHER PUBLICATIONS

First Office Action from the State Intellectual Property Office of China for Application No. 201410642807.5 dated Apr. 28, 2016 (11 pages).
(Continued)

*Primary Examiner* — Gregory Huson
*Assistant Examiner* — Daniel E Namay
(74) *Attorney, Agent, or Firm* — Michael Best & Friedrich LLP

(57) ABSTRACT

A gas premix burner and a gas water heater. The gas premix burner has a combustion direction, the gas premix burner can be matched and connected with a premix chamber that is disposed upstream the combustion direction of the gas premix burner, gas and air can be burned by the gas premix burner after mixed in the premix chamber; the gas premix burner comprising: a burner substrate, a main combustion hole provided on the burner substrate; an auxiliary combustion hole disposed downstream the main combustion hole
(Continued)

along the combustion direction on the burner substrate; an auxiliary flame of the auxiliary combustion hole intersects a main flame of the main combustion hole. The present application provides the main combustion hole upstream the auxiliary combustion hole along the combustion direction, since the main flame is usually larger in scale than the auxiliary flame, by providing the main flame upstream the auxiliary flame, it will be easier for the auxiliary flame and the main flame to intersect each other, and then the effect of stabilizing the flame is realized by opposed flames formed by the auxiliary flame and the main flame.

16 Claims, 6 Drawing Sheets

(51) Int. Cl.

| | |
|---|---|
| ***F23D 14/58*** | (2006.01) |
| ***F24H 9/18*** | (2006.01) |
| ***F23D 11/40*** | (2006.01) |
| ***F23D 14/14*** | (2006.01) |
| *F23D 14/16* | (2006.01) |

(52) U.S. Cl.
CPC ..... *F23D 14/58* (2013.01); *F23D 14/583* (2013.01); *F24H 9/1836* (2013.01); *F23D 2203/1026* (2013.01); *F23D 2209/20* (2013.01)

(58) Field of Classification Search
USPC ..... 431/354, 2, 7, 350, 328, 170, 326
See application file for complete search history.

(56) References Cited

U.S. PATENT DOCUMENTS

| | | | | |
|---|---|---|---|---|
| 5,408,984 | A * | 4/1995 | Maughan | F23D 14/14 126/39 D |
| 5,511,974 | A * | 4/1996 | Gordon | F23D 14/02 431/328 |
| 5,957,682 | A * | 9/1999 | Kamal | F23D 14/36 431/115 |
| 6,561,795 | B1 * | 5/2003 | Lasagni | F23D 14/105 239/556 |
| 8,523,561 | B2 | 9/2013 | Huang et al. | |
| 8,573,968 | B2 * | 11/2013 | Kaupert | F23D 14/22 431/350 |
| 8,647,112 | B2 * | 2/2014 | Huang | F23D 14/045 431/181 |
| 9,557,055 | B2 * | 1/2017 | Hagi | F23D 14/34 |
| 9,841,187 | B2 * | 12/2017 | Takeuchi | F23D 14/14 |
| 2006/0078836 | A1 * | 4/2006 | Kim | F23N 3/002 431/12 |
| 2006/0147865 | A1 * | 7/2006 | Czajka | F23D 14/065 431/354 |
| 2007/0298361 | A1 * | 12/2007 | Fogliani | F23D 14/02 431/354 |
| 2008/0131828 | A1 * | 6/2008 | Ojiro | F23D 14/14 431/350 |
| 2011/0111356 | A1 * | 5/2011 | Claerbout | F23D 14/14 431/329 |
| 2012/0244483 | A1 * | 9/2012 | Min | F23D 14/586 431/354 |
| 2013/0095441 | A1 * | 4/2013 | Akagi | F23D 14/62 431/354 |
| 2015/0167967 | A1 * | 6/2015 | Le Mer | F23D 14/02 431/328 |

FOREIGN PATENT DOCUMENTS

| | | | |
|---|---|---|---|
| CN | 102878561 | | 1/2013 |
| CN | 103196218 | | 7/2013 |
| CN | 203147762 | | 8/2013 |
| CN | 104048296 | | 9/2014 |
| CN | 104373937 | | 2/2015 |
| CN | 204213929 | | 3/2015 |
| EP | 2458277 | | 5/2012 |
| JP | 2000130715 | A * | 5/2000 |
| JP | 4600991 | | 12/2010 |
| WO | 2011010867 | | 1/2011 |

OTHER PUBLICATIONS

Second Office Action from the State Intellectual Property Office of China for Application No. 201410642807.5 dated Oct. 8, 2016 (5 pages).
PCT/CN2015/093788 International Search Report dated Feb. 15, 2016 (3 pages).

* cited by examiner

GAS PREMIX BURNER AND GAS WATER HEATER

TECHNICAL FIELD

The present application relates to the field of water heater, in particular relates to a gas premix burner and a gas water heater.

BACKGROUND TECHNOLOGY

Premix combustion refers to mixing gas and air in a premix chamber and burning the mixed gas on a burner. The structural design of the burner has a great influence to the combustion situation of the mixed gas. The existing burners, such as an Iron-chrome-aluminum wire mesh burner, are burners with the surface of the support element covered by a wire mesh made of a special material. The flames attach to the surface of the wire mesh, which has a high porosity, good flame stability, a large turndown ratio and a good level of pollutant emission. However, due to the particularity of the wire mesh, the manufacturing technique thereof is complex and the cost thereof is high.

In order to reduce the manufacturing difficulty, some plate type burners produced by simple manufacturing techniques have been developed. For example, the Chinese patent No. 201320092745, entitled "Full premix burner", and the Chinese patent No. 201310135997, entitled "Positive-pressure-injecting type fully-premixed combustion heating device", have both proposed a premix burner using a stainless steel plate or a plate with a certain curvature as the substrate. The fire holes thereof are a combination of circular or rectangular holes, the manufacturing thereof is simple, and the cost is low. However, the deficiency thereof lies in that the fire hole flame stability of the simplex circular or rectangular holes is poor. In a case where the gas supply flow is unstable, a flame lift phenomenon is likely to occur, which may further cause resonance of the burner, and thereby may result in damages to the components related to the burner. Furthermore, referring to the patent application No. 201410313365.X, entitled "Gas pre-mixing burner", it has proposed to provide a main combustion fire hole on a combustion platform higher than the substrate, and expects to achieve the effect of stabilizing the flame through the intersecting between the auxiliary flame of the auxiliary combustion fire hole and the main flame of the main combustion fire hole. However, in this patent application, the main combustion fire hole is higher than the auxiliary combustion fire hole, thus, for small load conditions, a situation may occur where the length of the auxiliary flame is not enough to well intersect the main flame, and at this point the stability of the flame is relatively poor.

SUMMARY

The embodiments of the present application provide a gas premix burner and a gas water heater having good flame stability.

In order to solve the above technical problem, the present application provides a gas premix burner, which has a combustion direction, the gas premix burner can be matched and connected with a premix chamber that is disposed upstream the combustion direction of the gas premix burner, gas and air can be burned by the gas premix burner after mixed in the premix chamber; the gas premix burner comprising: a burner substrate, a main combustion hole provided on the burner substrate; an auxiliary combustion hole disposed downstream the main combustion hole along the combustion direction on the burner substrate; an auxiliary flame of the auxiliary combustion hole intersects a main flame of the main combustion hole.

In one embodiment, the burner substrate has a substrate combustion surface; the burner substrate is provided with a combustion platform on which the main combustion hole is disposed, the combustion platform has a platform combustion surface provided upstream the substrate combustion surface along the combustion direction.

In one embodiment, the auxiliary combustion hole is located between the platform combustion surface and the substrate combustion surface.

In one embodiment, both of the main combustion hole and the auxiliary combustion hole are formed by processing the burner substrate.

In one embodiment, both of the main combustion hole and the auxiliary combustion hole are formed by punching the burner substrate, and the auxiliary combustion hole is a crack formed by the punching.

In one embodiment, shape of the main combustion hole and/or the auxiliary combustion hole is selected from long strip shape, circular shape, polygon shape or irregular shape.

In one embodiment, the main combustion hole is a long strip shaped hole of which a width is less than or equal to 3 mm; and/or the auxiliary combustion hole is a long strip shaped hole of which a width less than or equal to 3 mm.

In one embodiment, the auxiliary combustion hole is provided on the burner substrate, and a guiding nozzle is provided on a part of the auxiliary combustion hole close to the substrate combustion surface, so that the auxiliary combustion hole towards the main combustion hole or the main flame.

In one embodiment, the burner substrate is provided with a spacer for spacing two adjacent combustion platforms, and a width of the spacer is 25 mm or less.

In one embodiment, the spacer is provided with a third combustion hole.

In one embodiment, pore diameter of the third combustion hole is less than 3 mm, the spacer is provided with the third combustion holes of at least two different pore diameters, and the third combustion holes of different pore diameters are in a staggered arrangement relative to one another.

In one embodiment, total area of the main combustion holes is A1, total area of the auxiliary combustion holes is A2, area of the third combustion holes is A3, area of the burner substrate is A, porosity $K=(A1+A2+A3)/A$, wherein the numerical value of K is larger than 5%.

In one embodiment, material of the burner substrate is aluminum or stainless steel.

In one embodiment, the substrate combustion surface of the burner substrate is a flat face or a curved face.

The embodiments of the present application also provide a gas water heater mounted with any of the above described gas premix burners.

In one embodiment, a mixed gas distribution plate is installed in a premix chamber of the gas water heater, a vent hole is disposed on the mixed gas distribution plate, air and gas entered the premix chamber can pass through the vent hole and then be burned by the gas premix burner As can be seen from the technical solution provided by the above embodiments of the present application, in the gas premix burner provided in the present application, the main combustion hole is provided upstream the auxiliary combustion hole along the combustion direction. Since the main flame is usually larger in scale than the auxiliary flame, by providing the main flame upstream the auxiliary flame, it will be easier for the auxiliary flame and the main flame to intersect each other, and then the effect of stabilizing the flame is realized by opposed flames formed by the auxiliary flame and the main flame. Besides, since the main combustion hole sinks and the metal wall extends into the premix chamber, the mixed gas of gas and air is preheated before burned, so that the flame root is closer to the combustion hole of the burner during the combustion, and the combustion is thus more stable; in addition, since the main combustion hole sinks, the overall flame height on the surface of the whole gas premix burner is lowered, which is more beneficial to the stability of the combustion. In view of this, the present application has good thermal loads.

BRIEF DESCRIPTION OF THE DRAWINGS

In order to explain more clearly the embodiments in the present application or the technical solutions in the prior art, the following will briefly introduce the figures needed in the description of the embodiments or the prior art. Obviously, figures in the following description are only some embodiments recorded in the present application, and for persons skilled in the art, other figures may also be obtained based on these figures without paying creative efforts.

DETAILED DESCRIPTION

In order to enable the persons skilled in the art to better understand the technical solutions in this application, clear and comprehensive description will be made to the technical solutions in the embodiments of the present application will be made in the following in combination with the figures in the embodiments of the present application. Obviously, the embodiments described herein are only part of, rather than all of, the embodiments of the present application. Based on the embodiments of the present application, all other embodiments obtained by ordinary skilled persons in the field without paying creative efforts should pertain to the extent of protection of the present application.

Figure 1:
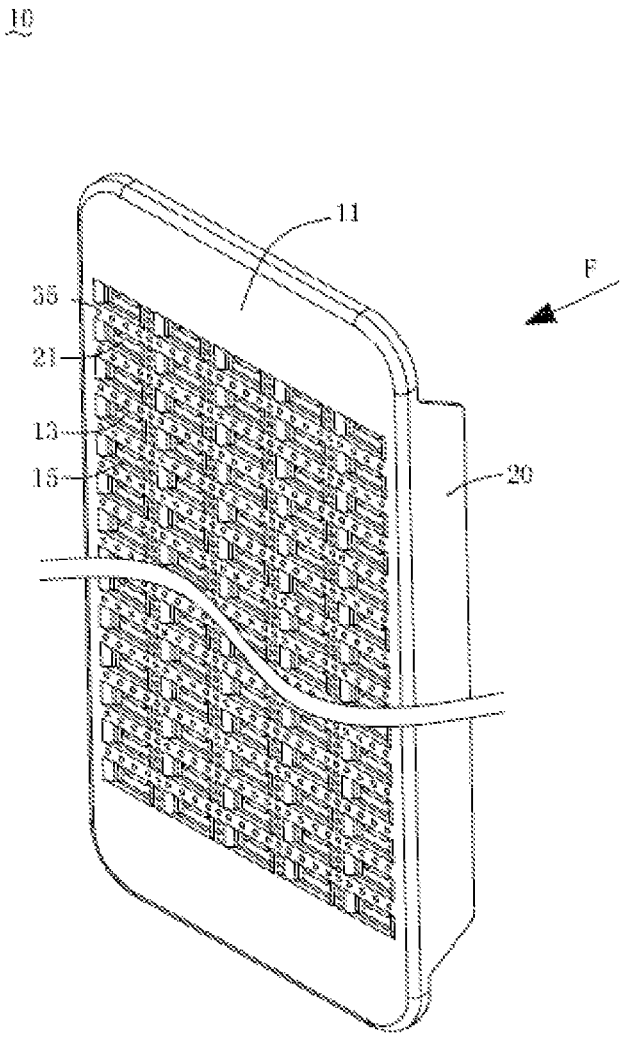
FIG. 1 is a stereogram of a gas premix burner provided by one embodiment of the present application.

Please refer to FIG. 1 which shows a gas premix burner 10 provided by one embodiment of the present application. The gas premix burner 10 has a combustion direction F. In use, the gas premix burner 10 can be matched and connected with a premix chamber that is disposed upstream the combustion direction F of the gas premix burner 10, such that air and gas mixed in the premix chamber can be burned after passing through the gas premix burner 10.

The gas premix burner 10 comprises: a burner substrate 11, and a main combustion hole 13 provided on the burner substrate 11; an auxiliary combustion hole 15 disposed downstream the main combustion hole 13 along the combustion direction F on the burner substrate 11; in a working state, the auxiliary flame of the auxiliary combustion hole 15 intersects the main flame of the main combustion hole 13.

Figure 2:
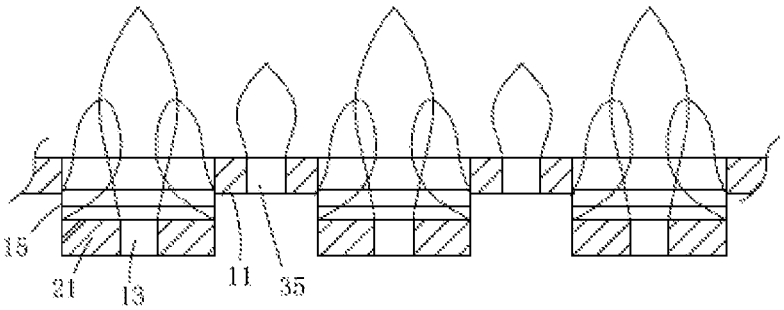
FIG. 2 is a schematic diagram of the operating status of a gas premix burner provided by one embodiment of the present application.

Referring to FIGS. 1 and 2 together, the embodiments of the present application provide the auxiliary combustion hole 15 downstream the main combustion hole 13 along the combustion direction F, and allow the auxiliary flame to intersect the main flame, achieving the effect of suppressing flame lifting, and thereby making the auxiliary flame and the main flame more stable. After the gas premix burner 10 is mounted to the gas water heater, the gas premix burner 10 is mated with the premix chamber, the air and gas are mixed in the premix chamber and form a mixed gas, and the mixed gas can be burned after passing through the gas premix burner 10. In order to realize the intersecting between the auxiliary flame and the main flame, an airflow direction of the mixed gas after passing through the auxiliary combustion hole 15 intersects an airflow direction of the mixed gas through the main combustion hole 13. To be specific, the airflow through the main combustion hole 13 may be a first airflow, and the flame produced by the combustion of the first airflow may be the main flame; the airflow through the auxiliary combustion hole 15 may be a second airflow, and the flame produced by the combustion of the second airflow may be the auxiliary flame. A direction of the first airflow intersects a direction of the second airflow, so that the main flame intersects the auxiliary flame, namely, an opposed flame phenomenon is generated. In some cases, the gas flow velocity in the premix chamber increases suddenly, resulting in an increase in flow velocities of the first airflow and the second airflow. Under the effect of the opposed flames of the main flame and the auxiliary flame, the flow velocities of the first airflow and the second airflow can be reduced, so that the opposed flames formed after the main flame and the auxiliary flame intersect each other can have a suppression effect to the flame lift phenomenon, so as to achieve the effect of stabilizing the main flame and the auxiliary flame.

Figure 3:
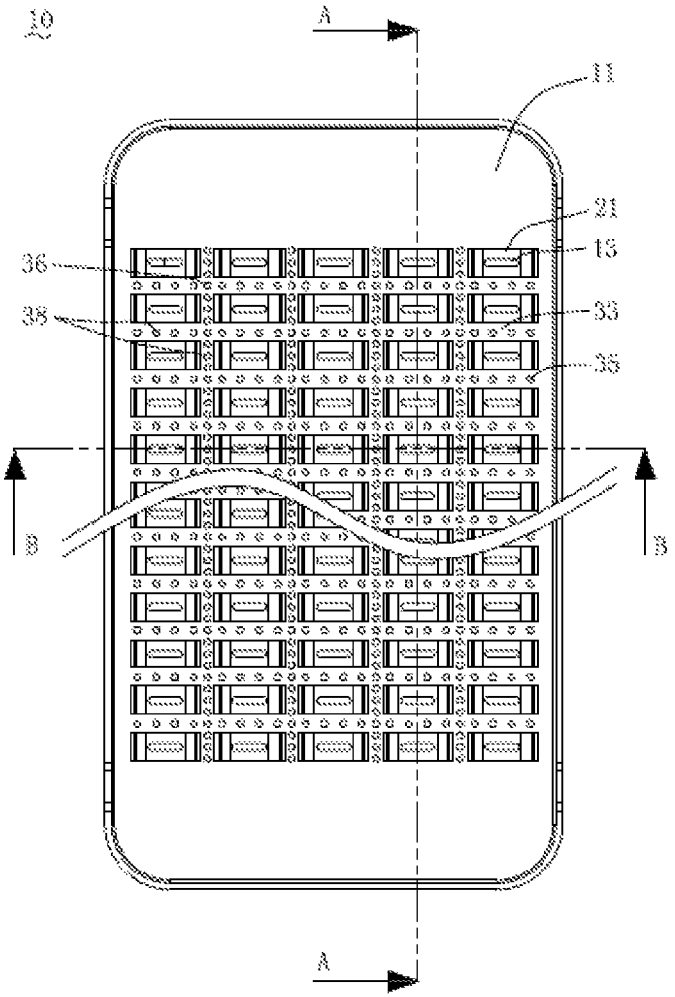
FIG. 3 is a front view of a gas premix burner provided by one embodiment of the present application.
Figure 4:
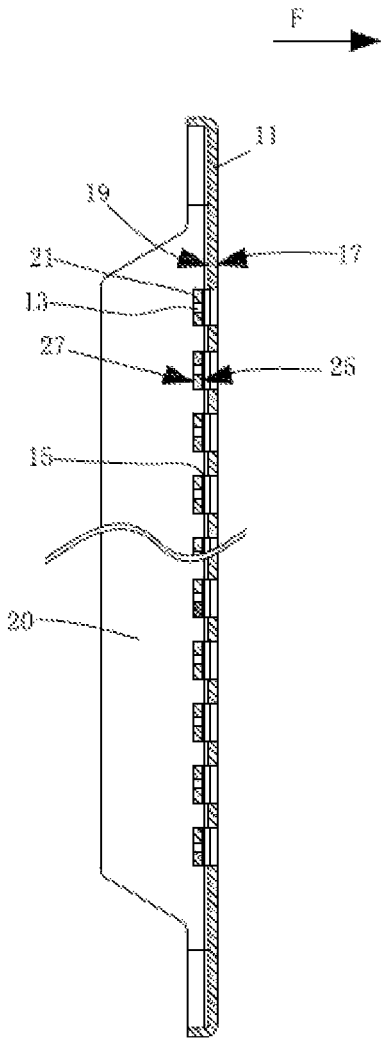
FIG. 4 is a cross-sectional view of the gas premix burner in FIG. 3 along a line A-A.
Figure 5:
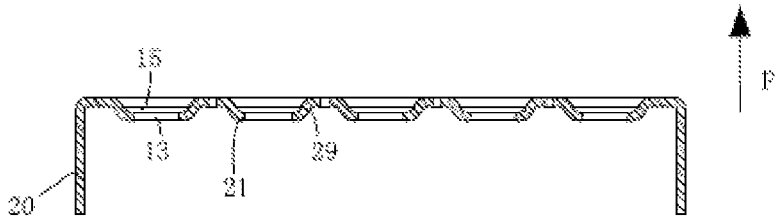
FIG. 5 is a cross-sectional view of the gas premix burner in FIG. 3 along a line B-B.

Referring to FIGS. 3, 4 and 5 together, the burner substrate 11 may be formed of a metal material. In this embodiment, it may be formed of aluminum or stainless steel materials. The burner substrate 11 has a substrate combustion surface 17 facing the main flame and a substrate air intake face 19 facing away from the main flame. The mixed gas can enter into a combustion state after passing through the burner substrate 11 from a substrate air intake face 19 to the substrate combustion surface 17. The substrate combustion surface 17 of the burner substrate 11 may be a flat face or a curved face. An edge of the substrate air intake face 19 may be provided with a mounting section 20 by which the gas premix burner 10 can be mated with the premix chamber when mounted to the premix chamber. The gas premix burner 10 can be mated with a single premix chamber individually. To be specific, the gas premix burner 10 may correspond to one premix chamber, such that the one premix chamber only needs to be mounted with one burner substrate 11, and thus the gas premix burner 10 can be more readily assembled with the premix chamber.

The burner substrate 11 may be provided with at least one combustion platform 21, on which the main combustion hole 13 is opened. The combustion platform 21 has a platform combustion surface 25 facing the main flame and a platform air intake face 27 facing away from the main flame. The platform combustion surface 25 is provided upstream the substrate combustion surface 17 along the combustion direction F of the premix chamber 10. In this embodiment, by setting the combustion platform 21 having the main combustion hole 13 on the burner substrate 11, the provision of the main combustion hole 21 on the burner substrate is realized.

In this embodiment, the platform combustion surface 25 is provided upstream the substrate combustion surface 17 along the combustion direction F, and such a setting can achieve the provision of the main combustion hole 13 upstream the auxiliary combustion hole 15 along the combustion direction F, namely, the auxiliary combustion hole 15 is located downstream the main combustion hole 13 along the combustion direction F. Since the scale of the main flame is larger than the auxiliary flame, the setting of the auxiliary combustion hole 15 downstream the main combustion hole 13 can facilitate the intersecting between the auxiliary flame and the main flame, thereby producing opposed flames. To be specific, the auxiliary combustion hole 15 may be provided on a position on the burner substrate 11 close to the combustion platform 21.

In one embodiment of the present application, the auxiliary combustion hole 15 is located between the platform combustion surface 25 and the substrate combustion surface 17. Since the platform combustion surface 25 is located upstream the substrate combustion surface 17 along the combustion direction F, there is a certain space between the platform combustion surface 25 and the substrate combustion surface 17. By setting the auxiliary combustion hole 15 between the platform combustion surface 25 and the substrate combustion surface 17, the auxiliary combustion hole 15 is closer to the main combustion hole 13 provided on the combustion platform 21, which helps the intersecting between the main flame and the auxiliary flame. Furthermore, the space between the platform combustion surface 25 and the substrate combustion surface 17 is downstream the platform combustion surface 25 along the combustion direction F. As introduced in the above, the auxiliary combustion hole 15 formed in the space can be oriented to the main combustion hole 13 or to the main flame, so as to further prompt the intersecting between the auxiliary flame and the main flame, thereby producing the effect of opposed flames. In this embodiment, the number of the auxiliary combustion hole 15 may be at least one. To be specific, for example: if the number of the auxiliary combustion hole 15 is one, it may be a bar shaped hole; and if the number of the auxiliary combustion holes 15 is two, then they may be provided oppositely on two sides of the combustion platform 21. Situations of greater numbers will not be discussed here.

In this embodiment, the gas premix burner 10 may also comprise a connecting section 29 for connecting the combustion platform 21 to the burner substrate 11. The connecting section 29 may constitute a side wall of the auxiliary combustion hole 15. When the number of the auxiliary combustion hole 15 is more than one, the connecting section 29 can space the adjacent auxiliary combustion holes 15. The connecting section 29 may also play a role of guiding the main flame, that is to say, in the combustion process the mixed gas flowing out from the main combustion hole 13 will move along the connecting section 29, allowing the main flame to be more concentrated, thereby reducing thermal losses.

In one embodiment of the present application, both of the main combustion hole 13 and the auxiliary combustion hole 15 are formed by processing the burner substrate 11. The main combustion hole 13 and the auxiliary combustion hole 15 may be formed on the burner substrate 11 by injection molding or punching molding. That is to say, the combustion platform 21 and the burner substrate 11 are formed integrally, allowing the gas premix burner 10 to be easily processed and manufactured. In this embodiment, preferably, both of the main combustion hole 13 and the auxiliary combustion hole 15 are formed by punching the burner substrate 11, and the auxiliary hole 15 is a crack formed by the punching.

Figure 6:
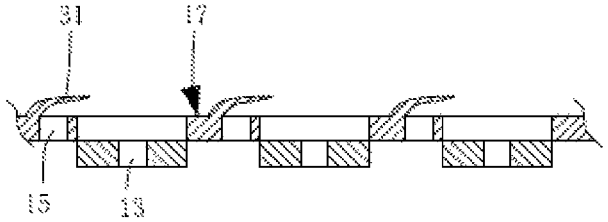
FIG. 6 is a cross-sectional schematic diagram of a gas premix burner provided by one embodiment of the present application.

Referring to FIG. 6, in one embodiment of the present application, the auxiliary combustion hole 15 is provided on the burner substrate 11, and a guiding nozzle 31 is provided on a part of the auxiliary combustion hole 15 close to the substrate combustion surface 17, so that the auxiliary combustion hole 15 towards the main combustion hole 13 or the main flame. In this embodiment, the auxiliary combustion hole 15 is oriented towards the main combustion hole 13 or the main flame by the guiding nozzle 31, thereby achieving to intersect the auxiliary flame with the main flame to produce opposed flames to suppress the flame lift phenomenon.

Of course, the burner substrate 11 is not limited to the above way of setting the main combustion hole 13 and the auxiliary combustion hole 15, but the main combustion hole 13 can also be set by directly opening a through hole on the burner substrate 11. Besides, it is also achievable to orient the auxiliary combustion hole 15 towards the main combustion hole 13 or the main flame to make the auxiliary flame intersects the main flame by setting the guiding nozzle protruding from the substrate combustion surface 17.

Referring to FIG. 1, in one embodiment of the present application, the shape of the main combustion hole 13 and/or the auxiliary combustion hole 15 is selected from a long strip shape, a circular shape, a polygon or an irregular shape. In this embodiment, specifically, the main combustion hole 13 is a long strip shaped hole of which a width is less than or equal to 3 mm; and/or the auxiliary combustion hole 15 is a long strip shaped hole of which a width less than or equal to 3 mm. The inventor has found through studies that the combustion effect of the gas premix burner 10 reaches the best when both of the main combustion hole 13 and the auxiliary combustion hole 15 are long strip shaped holes.

In one embodiment of the present application, the burner substrate 11 can be provided with a plurality of main combustion holes 13 and auxiliary combustion holes 15, wherein part of the main combustion holes 13 may be provided on one combustion platform 21 respectively, and part of the main combustion holes 13 may be directly opened on the burner substrate 11, and the auxiliary combustion holes 15 may also be set according to the descriptions in the above embodiments. Of course, an alternative would be to provide all the main combustion holes 13 on one combustion platform 21 respectively, and the auxiliary combustion holes 15 may be set according to the descriptions in the above embodiments.

Referring to FIGS. 1 and 3 together, in one embodiment of the present application, the burner substrate is provided with a spacer 33 for spacing two adjacent combustion platforms, and a width of the spacer 33 is 25 mm or less. The inventor has found through experiments that the thermal load per unit area of the gas premix burner reduces faster when the width of the spacer 33 is greater than 25 mm.

In one embodiment of the present application, the spacer 33 is provided with a third combustion hole 35. In this embodiment, the spacer 33 of the burner substrate 11 may also be opened with a third combustion hole 35, of which a gas ejecting direction may be the same with a gas ejecting direction of the main combustion hole 13. An open area of the third combustion hole 35 may be smaller than an open area of the main combustion hole 13, such that a length of the flame of the third combustion hole 35 will be less than a length of the main flame. The combustion holes of three forms are not likely to cause resonances compared to the existing hole of a single form.

In one embodiment, the pore diameter of the third combustion hole 35 is less than 3 mm, the spacer 33 is provided with the third combustion holes 35 of at least two different pore diameters, and the third combustion holes 35 of different pore diameters are in a staggered arrangement relative to one another. By setting in this way, reasonable thermal power distributions can be obtained, so that the main combustion hole 13 and the auxiliary combustion hole 15 can cooperate with each other. To be specific, for example: the projection of the combustion platform 21 in a top view direction may be a rectangle, and, a plurality of combustion platforms 21 are arranged in the form of a rectangular array on the burner substrate 11, the third combustion hole 35 is distributed on the spacer 33 between two adjacent combustion platforms 21, and a plurality of third combustion holes 35 can form a determinant arrangement having a certain row pitch and column pitch, wherein, the third combustion holes 35 can intersect each other in a row direction and a column direction, namely, the third combustion holes 35 can share one combustion hole in the row direction and column direction. The combustion hole is a large-caliber third combustion hole 36, and the rest third combustion holes are small-caliber third combustion holes 38. The pore diameter of the large-caliber third combustion hole 36 is greater than that of the small-caliber third combustion hole 38. The large-caliber third combustion hole 36 is provided on a center among two rows and two columns of, in total four, combustion platforms 21, and the distance from the center to each combustion platform 21 is the farthest. Therefore, there is relatively enough space at the center for setting the large-caliber third combustion hole 36, such that the combustion area can be increased sufficiently to improve the combustion efficiency. Furthermore, the inventor has found through studies that the thermal load per unit area can be improved when the pore diameter of the third combustion hole 35 is less than 3 mm. In this embodiment, the third combustion hole 35 can increase the combustion porosity to improve the thermal load per unit area.

In one embodiment, total area of the main combustion hole 13 is A1, total area of the auxiliary combustion hole 15 is A2, area of the third combustion hole 25 is A3, area of the burner substrate is A, and the porosity K=(A1+A2+A3)/A, wherein the numerical value of K is larger than 5%. The porosity K=(A1+A2+A3)/A, and the value indicates the use ratio of the burner substrate. When the porosity is greater, the thermal load produced per unit area of the cross section of the combustion chamber is also greater, i.e., the use ratio of the burner substrate is higher; in other words, under the same requirement for thermal load, the burner with a larger porosity will have a smaller total area. The numerical value of the porosity K in the present application is greater than 5%, thus the gas premix burner 10 has a good thermal load and use ratio.

The present application also provides a gas water heater which may be mounted with the gas premix burner 10 introduced in any of the above embodiments. The gas water heater has a relatively high heating efficiency, and is capable of well preventing the flame lift phenomenon from happening, thereby prolonging the service life of the product.

Figure 7:
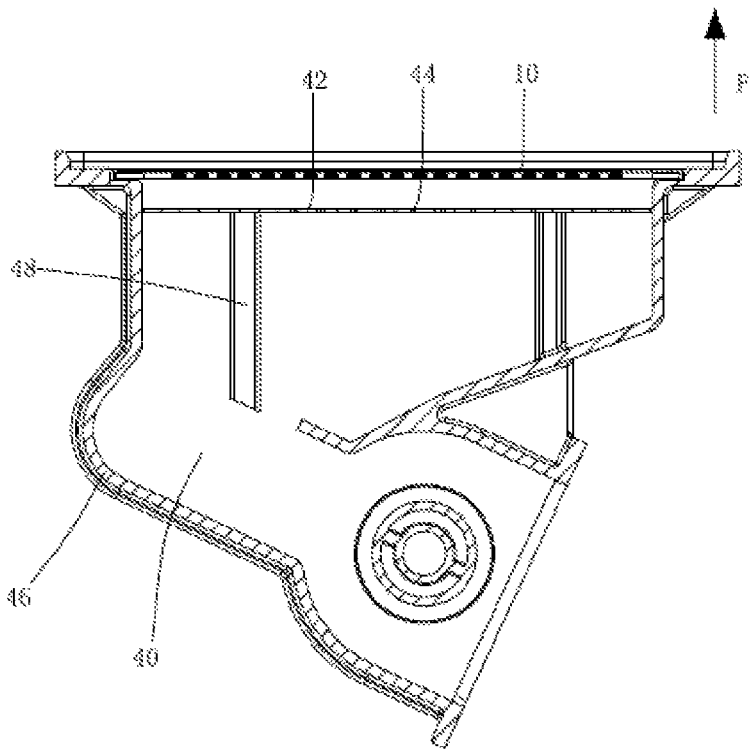
FIG. 7 is a schematic diagram of the mating between a premix chamber and a gas premix burner provided by one embodiment of the present application.

Referring to FIG. 7, in one embodiment of the present application, a mixed gas distribution plate 42 is installed in the premix chamber 40 of the gas water heater, a vent hole 44 is disposed on the mixed gas distribution plate 42, and air and gas entered the premix chamber 40 can pass through the vent hole 44 and then be burned by the gas premix burner 10. By setting the mixed gas distribution plate 42, the air and gas entering the premix chamber can be mixed more sufficiently, so that the mixed gas can be burned more sufficiently at the gas premix burner 10. The premix chamber 40 is bounded by a housing 46, and a support 48 may be provided on a side wall inside the housing 46 for mounting the mixed gas distribution plate 42.

As can be seen from the technical solution provided in the above embodiments of the present application, in the gas premix burner provided in the present application, the main combustion hole is provided upstream the auxiliary combustion hole along the combustion direction. Since the main flame is usually larger in scale than the auxiliary flame, by providing the main flame upstream the auxiliary flame, it will be easier for the auxiliary flame and the main flame to intersect each other, and then the effect of stabilizing the flame is realized by opposed flames formed by the auxiliary flame and the main flame. In view of this, the present application has a good thermal load.

Although the present application is described through the embodiments, under the inspiration of the technical spirits of the present application, persons skilled in the art can combine the above embodiments, and can also make changes to the embodiments of the present application, which should all be covered under the protection scopes of the present application as long as the functions and effects realized thereby are the same or similar to the present application.

The invention claimed is:

1. A gas premix burner that can be matched and connected with a premix chamber disposed upstream of a combustion direction of the gas premix burner, such that gas and air can be burned by the gas premix burner after being mixed in the gas premix chamber, the gas premix burner comprising:

a burner substrate, a main combustion hole provided on the burner substrate; and an auxiliary combustion hole disposed downstream from the main combustion hole along the combustion direction on the burner substrate, the auxiliary combustion hole oriented toward the main combustion hole or a main flame formed by the main combustion hole;

wherein an auxiliary flame of the auxiliary combustion hole intersects a main flame of the main combustion hole.

2. The gas premix burner according to claim 1, wherein the burner substrate has a substrate combustion surface, wherein the burner substrate is provided with a combustion platform on which the main combustion hole is disposed, and wherein the combustion platform has a platform combustion surface provided upstream the substrate combustion surface along the combustion direction.

3. The gas premix burner according to claim 2, wherein the auxiliary combustion hole is located between the platform combustion surface and the substrate combustion surface.

4. The gas premix burner according to claim 2, wherein the auxiliary combustion hole is provided on the burner substrate, and wherein a guiding nozzle is provided on a part of the auxiliary combustion hole close to the substrate combustion surface, so that the auxiliary flame is directed towards the main combustion hole or the main flame.

5. The gas premix burner according to claim 2, wherein the burner substrate is provided with a spacer for spacing two adjacent combustion platforms, and wherein a width of the spacer is 25 mm or less.

6. The gas premix burner according to claim 5, wherein the spacer is provided with a third combustion hole.

7. The gas premix burner according to claim 6, wherein a pore diameter of the third combustion hole is less than 3 mm, wherein the spacer is provided with the third combustion holes of at least two different pore diameters, and wherein the third combustion holes of different pore diameters are in a staggered arrangement relative to one another.

8. The gas premix burner according to claim 6, wherein a total area of the main combustion holes is A1, a total area of the auxiliary combustion holes is A2, an area of the third combustion holes is A3, an area of the burner substrate is A, and porosity is K=(A1+A2+A3)/A, and wherein the numerical value of K is larger than 5%.

9. The gas premix burner according to claim 2, wherein the substrate combustion surface of the burner substrate is one of a flat face and a curved face.

10. The gas premix burner according to any one of claims 1, wherein both of the main combustion hole and the auxiliary combustion hole are formed by processing the burner substrate.

11. The gas premix burner according to claim 10, wherein both of the main combustion hole and the auxiliary combustion hole are formed by punching the burner substrate, and the auxiliary combustion hole is a crack formed by the punching.

12. The gas premix burner according to claim 1, wherein a shape of at least one of the main combustion hole and the auxiliary combustion hole is selected from a long strip shape, a circular shape, a polygon shape, and an irregular shape.

13. The gas premix burner according to claim 12, wherein at least one of the main combustion hole and the auxiliary combustion hole is a long strip shaped hole having a width less than or equal to 3 mm.

14. The gas premix burner according to claim 1, wherein a material of the burner substrate is aluminum or stainless steel.

15. A gas water heater comprising:

a gas premix chamber; and a gas premix burner connected with the gas premix chamber, the gas premix chamber being disposed upstream of a combustion direction of the gas premix burner, such that gas and air can be burned by the gas premix burner after being mixed in the gas premix chamber, the gas premix burner including a burner substrate, a main combustion hole provided on the burner substrate, and an auxiliary combustion hole disposed downstream the main combustion hole along the combustion direction on the burner substrate, the auxiliary combustion hole oriented toward the main combustion hole or a main flame formed by the main combustion hole, wherein an auxiliary flame of the auxiliary combustion hole intersects a main flame of the main combustion hole.

16. The gas water heater according to claim 15, wherein a mixed gas distribution plate is installed in the gas premix chamber of the gas water heater, and wherein a vent hole is disposed on the mixed gas distribution plate, such that air and gas entering the premix chamber can pass through the vent hole and then be burned by the gas premix burner.

* * * * *